United States Patent [19]

Strauss

[11] 4,208,831

[45] Jun. 24, 1980

[54] DRIVING SIMULATOR TOY

[75] Inventor: Manfred Strauss, Randolph, N.J.

[73] Assignee: Shelcore, Inc., New York, N.Y.

[21] Appl. No.: 8,611

[22] Filed: Feb. 1, 1979

[51] Int. Cl.[2] ..... A63H 33/00

[52] U.S. Cl. ..... 46/1 B

[58] Field of Search ..... 46/1 B, 32; 35/12 H, 35/12 F, 60, 11 R, 11 A; D19/63; D21/142; 108/43; 272/1 C

[56] References Cited

U.S. PATENT DOCUMENTS

| | | | |
|---|---|---|---|
| D. 189,584 | 1/1961 | Robbins et al. | D19/63 X |
| 2,684,243 | 7/1954 | Alston | 272/1 C |
| 3,120,716 | 2/1964 | Orenstein | 46/1 B |
| 3,123,935 | 3/1964 | Williams | 108/43 X |
| 3,204,367 | 9/1965 | Stubbmann | 46/32 |
| 3,659,375 | 5/1972 | Stubbmann | 46/1 B |
| 3,917,275 | 11/1975 | Alpher | 46/32 |

*Primary Examiner*—F. Barry Shay

*Attorney, Agent, or Firm*—Kirschstein, Kirschstein, Ottinger & Cobrin

[57] ABSTRACT

A driving simulator toy realistically duplicates the actual driving environment of an automobile. The toy has a tunnel-like structure which accommodates the outstretched legs of a seated child to thereby simulate a low-slung bucket-seat environment.

13 Claims, 4 Drawing Figures

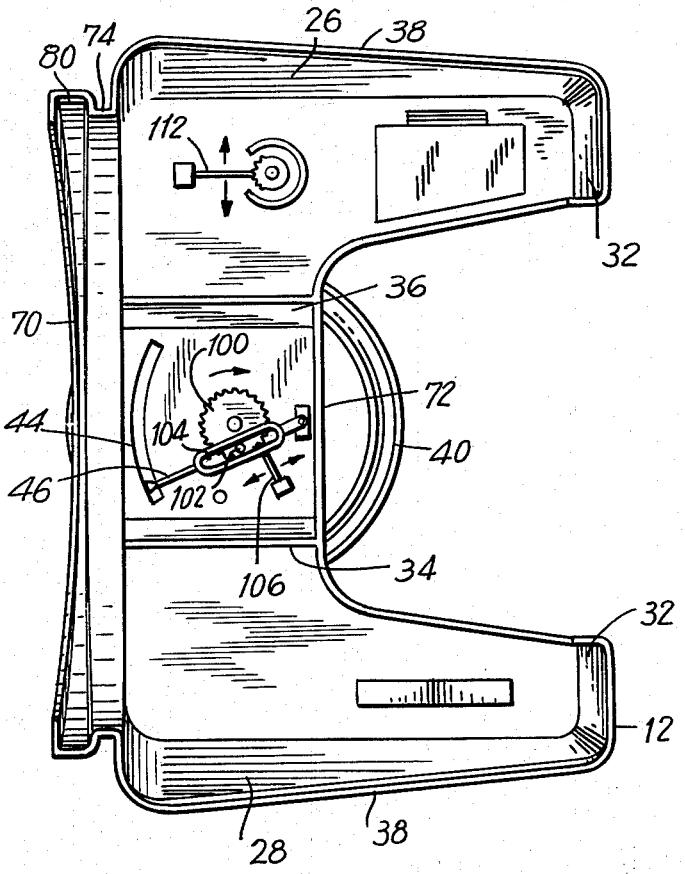
FIG. 3
FIG. 4
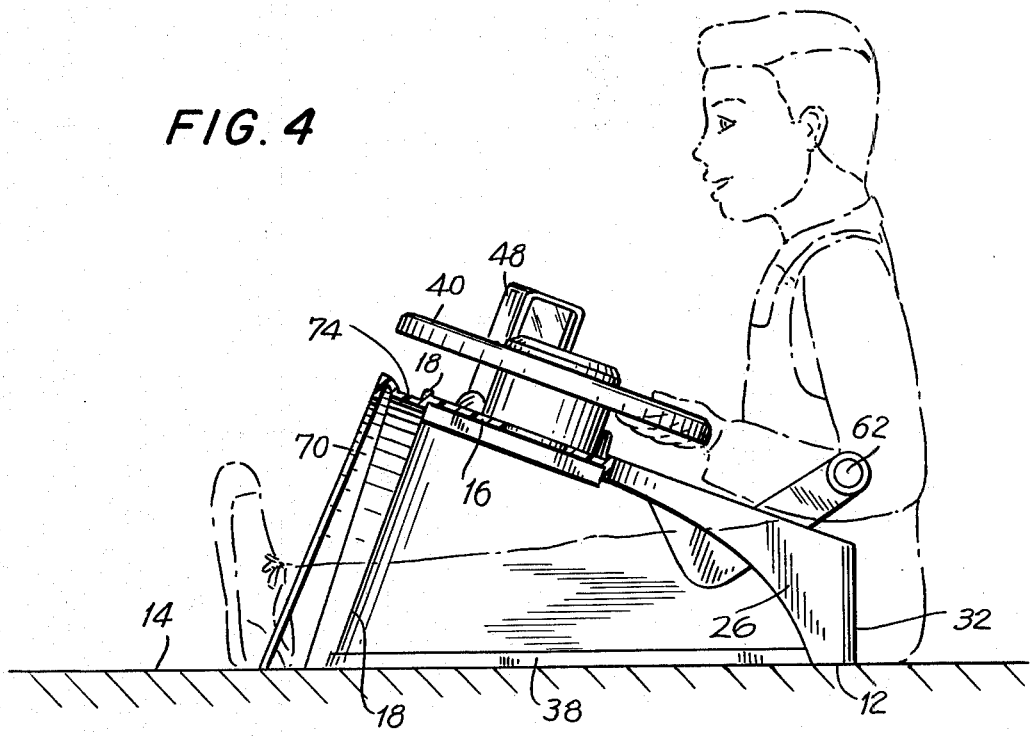

DRIVING SIMULATOR TOY

BACKGROUND OF THE INVENTION

1. Field of the Invention

This invention relates to a toy suitable for children of young ages and particularly, to a toy which simulates the environment of an automobile and enables a child to simulate the motions of a person driving a car.

2. Description of the Prior Art

Many toys designed for young children do not maintain the child's interest for a long period of time. This is usually due to the fact that most toys specifically designed for young children do not produce visual or audio responses to the child's physical manipulation of the toy. In addition, many children's toys are not designed to relate to the child's real-life everyday observations and experiences. As a result, after a relatively short period of playing time, the child no longer finds the toy exciting and very rarely plays with it again.

One of the most exciting experiences to many children is riding in an automobile and, after watching the driver manipulate the controls, the child invariably imitates the motions of the driver. The audio and visual responses to a driver's manipulation of the various driving controls, such as a steering wheel or a horn, capture the child's attention and interest.

There have been a number of prior art toys designed to enable a child to simulate the actions of driving an automobile. Some of these prior art toys are the subject matter of U.S. D-197,339; D-200,863; D-220,636; and U.S. Pat. Nos. 2,733,543; 3,120,716; 3,659,375; and 3,715,832.

Although these patented driving simulator toys are generally satisfactory for their intended purposes, they do not provide a totally realistic driving environment for a child. On most of the toys, the driving controls are mounted on a dashboard-like frame which rests directly on the floor. To play with the toy, the child has to sit with legs crossed in front of the toy and, thereupon, stretch his arms out a relatively long distance to reach and manipulate the various controls. Otherwise, the child would have to sprawl out on the floor in a prone position on his stomach or his side so that he could manipulate all of the controls.

In another application, the console was supported, not on the floor, but by a standing child by means of a neck strap.

In all of these prior art simulator toys, the child either had to stand, sit with legs crossed, or sprawl out on his stomach or side in a generally prone position. None of these positions realistically duplicated the actual position of a driver of an automobile. Particularly, none of these positions simulated the orientation of a driver of a sports car, wherein the driver sits in a low-slung bucket seat with his legs fully outstretched.

The prior art toys, therefore, did not permit a child to orient his body relative to the driving controls in a real-life driving position. The child, thus, does not truly believe he is behind the wheel of a car and, therefore, quickly loses interest in playing with the toy.

SUMMARY OF THE INVENTION

1. Objects of the Invention

Accordingly, it is the general object of the present invention to overcome the above-identified drawbacks of the prior art.

It is an object of this invention to create a real-life driving environment for a child by permitting the child to play with the toy while seated with his legs fully extended.

Another object of this invention is to reliably simulate a low-slung bucket seat so that a child believes he is riding in a sports car.

Still another object of this invention is to properly position a child at the toy so that he does not tire easily, has easy access to all of the controls, and does not lose interest after a short period of using the toy.

An object of this invention is to enable a child to simulate the motions of a driver of an automobile, particularly a sports car.

Another object of this invention is to provide a toy which simulates a driving environment and produces an immediate visual or audio response to a child's manipulation of the toy.

Still another object of this invention is to provide a driving simulator toy which is simple and inexpensive to manufacture and durable in use.

Another object of this invention is to provide a driving simulator toy which is safe for a child to use.

2. Features of the Invention

In keeping with these objects, and others which will become apparent hereinafter, one feature of the invention resides, briefly stated, in a driving simulator toy which comprises a driving console. This driving console comprises a base for supporting the console on a generally horizontal surface, a top dashboard-like panel juxtaposed above the base, which panel has a front, a rear, and a pair of side edge portions. The driving console also comprises a pair of side panels which extend upwardly from and connects the base to the respective side edge portions of the top panel, a front end panel which extends upwardly from and connects the base to the front edge portion of the top panel, a rear end panel which extends upwardly from and connects the base to the rear edge portion of the top panel, all of these side and end panels maintaining the top panel at an elevated position above the support surface.

The driving simulator toy further comprises a plurality of amusement-type driving control devices which are mounted on the console in easy reach of a child seated at the same. One of these driving control devices constitutes a toy steering wheel which is mounted on the dashboard-like panel. The driving simulator toy further comprises bucket seat simulator means on the console which permit a child to operate all of the driving control devices while being seated at the console with legs outstretched. These bucket seat simulator means, which enable a child to simulate the driving environment of an automobile, includes means at the rear of the console which defines a rear cutout extending forwardly along a central portion of the top wall for a distance sufficient to accomodate the lower torso of a seated child, this cutout extending upwardly along a central portion of the rear panel for a distance sufficient to accomodate the upper thigh region of the seated child. The bucket seat simulator means also includes means at the front of the console which define a front cutout extending upwardly along a central portion of the front panel for a distance sufficient to accomodate the legs of the seated child. Both the front and rear cutouts are aligned with one another and form a tunnel-like structure which accomodates the outstretched legs of the seated child, thereby simulating the bucket seat environment of a sports car.

The tunnel-like structure for accomodating the child's fully outstretched legs effectively simulates the real-life driving environment, particularly of a low-slung sports car. The child is partially surrounded by the console and, therefore, the child has easy access to all of the controls. The child will not tire easily because he no longer needs to stand, or sit with his legs crossed, or lie in an uncomfortable prone position on the floor.

The novel features which are considered as characteristic for the invention are set forth in particular in the appended claims. The invention itself, however, both as to its construction and operaton, together with additional objects and advantages thereof, will be best understood from the following description of specific embodiments when read in connection with the accompanying drawings.

BRIEF DESCRIPTION OF THE DRAWINGS

FIG. 3 is a bottom plan view of the driving simulator toy of FIG. 1; and

FIG. 4 is a sectional view as taken along line 4—4 of FIG. 1 and shows the child in phantom lines.

DETAILED DESCRIPTION OF THE PREFERRED EMBODIMENTS

Figure 1:
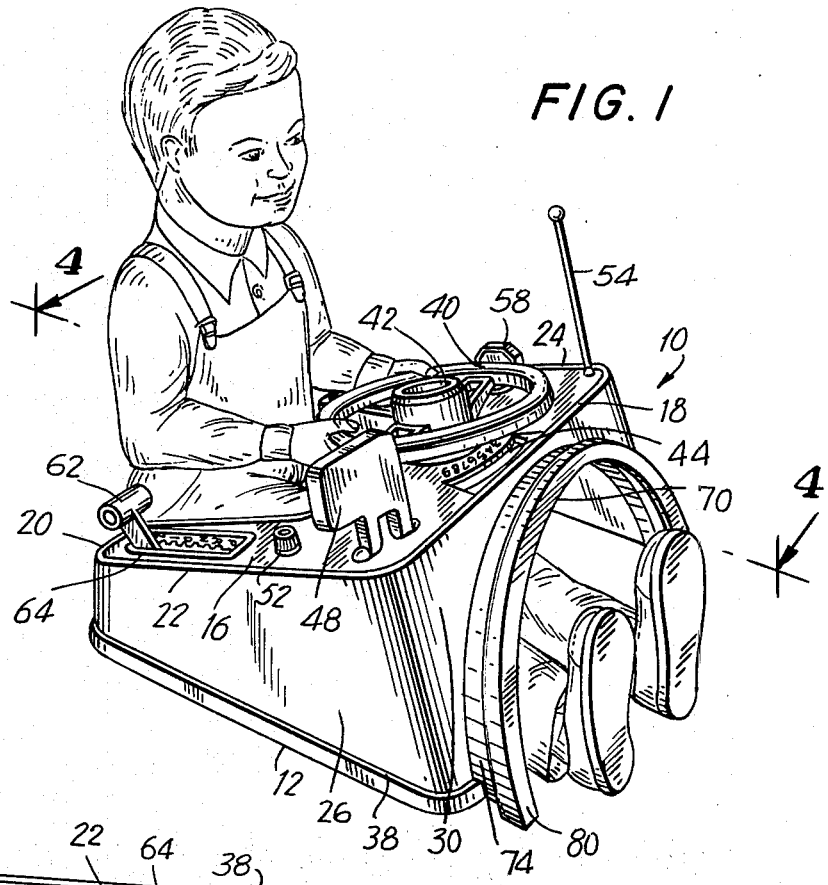
FIG. 1 is a perspective view of a driving simulator toy with a child seated with legs fully extended in accordance with the present invention.
Figure 2:
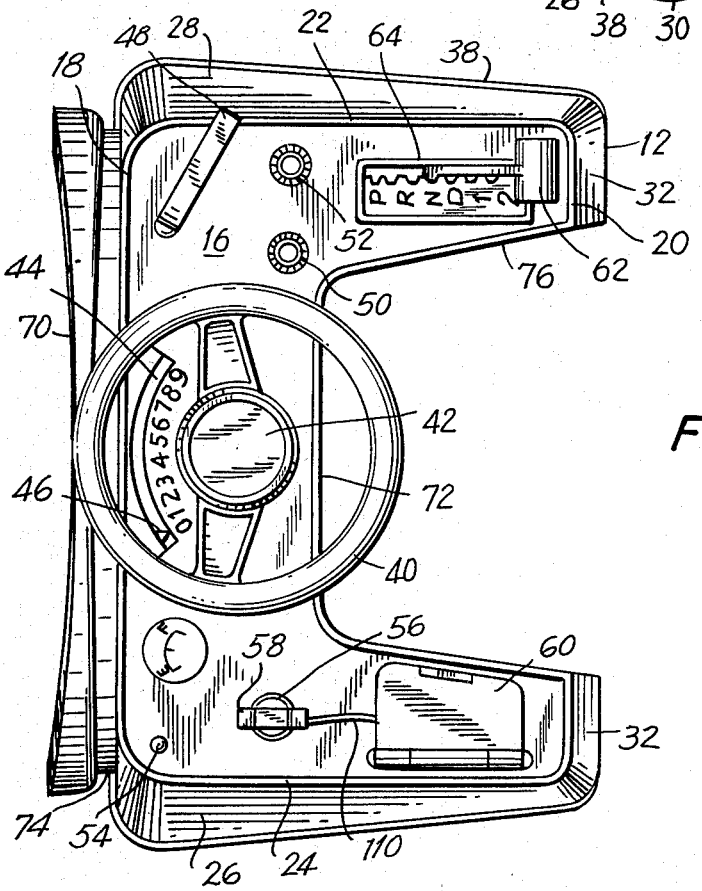
FIG. 2 is a top plan view of the driving simulator toy of FIG. 1.

Referring now to the drawings, the driving simulator toy comprises a generally U-shaped driving console which partially wraps around a child's body to thereby simulate the real-life driving environment of an automobile. The console 10 has a base 12 which rests on a generally horizontal support surface such as a floor 14, and a top dashboard-like panel 16 juxtaposed over the base 12. The top panel 16 has a front edge 18, a rear edge 20, and a pair of side edges 22, 24. For ease of description, the terms "front" and "rear" have been chosen to respectively correspond to the leading and trailing ends of an actual automobile when it moves forward. In the drawings, the child is placed at the rear end and facing toward the front.

The console 10 also has a pair of side panels 26, 28, each extending from a respective side edge 24, 22 to the base. The console 10 includes a front end panel 30 and a rear end panel 32. Front panel 30 extends upwardly from the base and connects the same to the front edge 18. Rear end panel 32 extends upwardly from the base and connects the same to the rear edge 20.

The front end panel 30 is inclined rearwardly. The side panels 24, 26, are configurated such that their front portions are higher than their corresponding rear portions. Hence, the side and end panels maintain the top panel 16 above the floor 14 at an inclined orientation relative to the same. The top panel 16 generally defines a right angle with the front panel 30 and slopes towards the floor in rearward direction.

The rear end panel 32 is generally perpendicular to the floor or may be slightly rearwardly inclined. The side panels 26, 28 are preferably perpendicular to the floor, but may also be slightly outwardly inclined. When the front, rear and side panels are inclined, as described above, the console has a generally frusto-pyramidal configuration, whose wide base provides great stability and strength for the toy.

Reinforcing ribs 34, 36 at the underside of the toy extend from the front panel towards the rear panel. Reinforcing ribs 34, 36 are of one-piece with the top panel and reinforce the same. Reinforcing rib 38 at the base 12 projects slightly outwardly of the side and front panels at the lower edge regions thereof to thereby reinforce the base 12, as well as providing a wider floor-engaging support surface to support the toy.

A plurality of amusement-type driving control devices are mounted on the console within easy reach of a child sitting on the floor. One control device is a steering wheel 40 which is rotatably mounted in the center of the top panel 16 directly in front of the child. A noisemaker or push-type horn 42 is mounted at the hub of the wheel on the steering post which defines the axis of rotation.

An arcuate viewing window 44 is located on the top panel adjacent the wheel 40. The center of curvature of the window 44 is located on the axis of rotation of the wheel. An indicator or pointer 46 is operatively connected with the wheel by a linkage mechanism operative for moving the pointer 46 from one end of the window towards its opposite end in response to turning of the wheel in either circumferential direction. The further the wheel is turned, the further the pointer 46 will move.

The linkage mechanism includes a starwheel 100 mounted on the steering post for rotation therewith. A pin 102 is eccentrically mounted on the starwheel 100 for rotation therewith. The pin 102 is received and guided in a slot 104 formed on the pointer 46. As the wheel is turned in one circumferential direction, the pin 102 moves along the slot and urges the indicator towards the center of the viewing window when the pin is located at one extreme end of the slot. Continued rotation of the wheel causes the pin to move towards the opposite end of the slot and concomitantly urges the indicator towards the opposite end region of the window. A flap 106 of resilient material is stationarily mounted on the underside of the top wall. The flap 106 engages the teeth of the starwheel 100 and makes a clicking sound when the wheel is moved. This control device simulates the automobile speedometer.

Another control device is a rear view mirror 48 which is pivotally mounted at an elevated part of the forward portion of the top wall for movement between a non-use position, in which the mirror lies parallel to the top wall, and a use position, in which the mirror lies generally perpendicular to the top wall. In the use position, the child can view objects behind him, thereby simulating the action of an automobile rear view mirror.

Another control device is a pair of radio-like knobs 50, 52 mounted for rotation relative to the top wall. One knob serves as an on/off indicator and the other knob serves as a channel selector. An antenna 54 is mounted on the top wall. By manipulating the knobs, a child simulates the turning of automobile radio control knobs.

A key-receiving member 56 is mounted for rotation on the top wall adjacent the wheel. A key 58 is tethered by string 110 to the top wall. The key 58 is initially stored in the key storage compartment 60, which is normally closed by a hinged door. In use, the child opens the door, removes the key from the compartment, and inserts the key into the key-receiving member and thereupon turns the key. This sequence of events simulates the starting of a car by turning an automobile ignition key in an ignition keyhole.

Another resilient flap 112 is located on the underside of the top wall. The free end of the resilient flap 112 engages a toothed portion on the key-receiving member to thereby generate a clicking sound when the key turns the key-receiving member.

A gearshift lever 62 is pivotally mounted for movement in gear slot 64 which has a series of indentations spaced lengthwise of the slot. The lever has a detent of resilient material on its side which cams into and out of the indentations as the lever is moved lengthwise of the slot. The detent will snap into any selected indentation. This action corresponds to the manual selection of the gear ratio of an actual car.

In accordance with the present invention, bucket seat simulator means are provided on the console for permitting a child to operate all of the above-described drive control devices while being seated at the console with his legs outstretched so as to simulate the driving environment of an automobile, particularly a sports car. The bucket seat simulator means constitutes wall portions defining a front cutout at the front of the toy, and a rear cutout at the rear of the toy.

The front cutout 70 is formed at the front panel 30 and extends upwardly along a central portion of the front panel for a distance sufficient to accomodate the legs of the seated child. A semi-circular tunnel extension 74 extends forwardly of the front panel 30 and the inner circumferential wall of the tunnel extension bounds the front cutout 70. The height and width of the tunnel extension above the floor is selected so that a child's legs and feet can fit therethrough in a side-by-side position with clearance. The semi-circular tunnel extension 74 forms an arch at the front panel which further reinforces and strengthens the toy. A reinforcing rib 80 extends about the semi-circular periphery of the extension 74 and serves to further reinforce the toy.

The rear cutout 72 is formed at the rear panel 32 and extends in two directions. First, the rear cutout 72 extends upwardly from the base along a central portion of the rear panel 32 for the entire height of the same. In effect, the entire central portion of the rear panel is removed. Secondly, the rear cutout 72 extends from the rear panel 32 forwardly along a central portion of the top wall 16 towards the front panel 30 but terminates short thereof. The rear cutout 72 is bounded by a U-shaped rim 76 at the top wall.

The dimensions of the rear cutout 72 are chosen so that a child's lower torso and upper thighs can be accomodated therein with clearance without the entire toy being lifted off the floor. The U-shaped rim 76 serves as an end-limiting abutment for a child's stomach. The front and rear cutouts are aligned with one another and together form a tunnel-like structure which accomodates the outstretched legs of the child.

It will be appreciated that the seated child is partially surrounded by the U-shaped wraparound console. Once sitting with his legs outstretched, the console sides are located at opposite sides of the child's body. The child's right hand now conveniently overlies the right arm extension of the console, and the child's left hand conveniently overlies the left arm extension of the console. The child can sit forwardly into the rear cutout 72 so that he can gain easy access to all of the more forward driving control devices. The child's legs are located in the tunnel-like structure underneath the floor-mounted console so that the child will now sit in a true-to-life driving environment.

The driving position of the child resembles a low-slung bucket seat of a sports or racing car to thereby provide entertainment reward for the child. Preferably, the console is made of synthetic plastic material. Artwork, such as gauge representations, is provided on the top panel to simulate an automobile dashboard.

Although the above-described invention has been described in terms of an automobile simulator toy, it will be expressly understood that the invention is not intended to be limited to automobiles. For example, the control devices may be devices as commonly found on airplanes, boats, steamships, trains, spaceships, and in fact, even unrelated games and control devices may be mounted on the top wall. In the latter case, the instant invention would serve as a play desk or activity center, having at least one game or acitvity such as a chalkboard to amuse the child.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A driving simulator toy comprising:

(a) a driving console having (i) a base for supporting the console on a generally horizontal support surface, (ii) a top dashboard-like panel juxtaposed above the base and having a front, a rear, and a pair of side edge portions, (iii) a pair of side panels each extending upwardly from and connecting the base to the respective side edge portions of the top panel, (iv) a front end panel extending upwardly from and connecting the base to the front edge portion of the top panel, (v) a rear end panel extending upwardly from and connecting the base to the rear edge portion of the top panel, and (vi) all of said side and end panels maintaining said top panel at an elevated position above the support surface;

(b) a plurality of amusement-type driving control devices mounted on the console within easy reach of a child seated at the same on the support surface, one of the driving control devices constituting a toy steering wheel mounted on the top dashboard-like panel; and (c) bucket seat environment simulator means on the console for permitting a child to operate all of the driving control devices while being seated at the console with legs outstretched so as to simulate the driving environment of an automobile, particularly a sports car, said bucket seat environment simulator means including (i) means at the rear of the console for defining a rear cutout which extends forwardly along a central portion of the top panel for a distance sufficient to accomodate the lower torso of the seated child, at least one of said control devices being mounted on said top panel laterally of said rear cutout and rearwardly of said top panel central portion, said rear cutout also extending upwardly along a central portion of the rear panel for a distance sufficient to accomodate the upper thigh region of the seated child, (ii) means at the front of the console for defining a front cutout which extends upwardly along a central portion of the front panel for a distance sufficient to accomodate the legs of the seated child, and (iii) said front and rear cutouts being aligned with one another and together forming a tunnel-like structure which accomodates the outstretched legs of the seated child to thereby simulate the bucket seat environment of a sports car.

2. The driving simulator toy of claim 1, wherein said side and end panels support the top dashboard-like panel at an inclined orientation relative to the support surface.

3. The driving simulator toy of claim 1, wherein said front panel is inclined rearwardly relative to the support surface.

4. The driving simulator toy of claim 1, wherein said front cutout has a semi-circular configuration.

5. The driving simulator toy of claim 1, wherein said front cutout-defining means includes a tunnel extension extending forwardly of said front panel.

6. The driving simulator toy of claim 5; and further comprising a reinforcing portion of one-piece with said tunnel extension.

7. The driving simulator toy of claim 1, wherein said toy steering wheel is mounted for rotation on said top panel; and further comprising a noise-maker on said wheel.

8. The driving simulator toy of claim 7, wherein another of said driving control devices is a toy speedometer mounted on said top panel adjacent said toy steering wheel, said speedometer having an elongated window and a pointer mounted for turning movement with said toy wheel, said pointer being viewable in and movable lengthwise of the window in response to turning of the toy wheel.

9. The driving simulator toy of claim 1, wherein another of said driving control devices constitutes a key receiving member rotatably mounted adjacent said toy steering wheel on said top panel, a key storage compartment adjacent said key receiving member, and a key removably stored in the key storage compartment and insertable in said key receiving member for simulating the insertion and turning of an automobile ignition key into an ignition keyhole.

10. The driving simulator toy of claim 1, wherein another of said driving control devices is a rear view mirror pivotally mounted on said top panel adjacent said toy steering wheel.

11. The driving simulator toy of claim 1, wherein another of said driving control devices is a pair of radio-like knobs rotatably mounted on said top panel adjacent said toy steering wheel.

12. The driving simulator toy of claim 1, wherein another of said driving control devices is a gear lever mounted for movement in a gear lever slot to simulate the manual shifting of gears in an automobile.

13. An activity center toy comprising:

(a) a console having (i) a base for supporting the console on a generally horizontal support surface, (ii) a top panel juxtaposed above the base and having a front, a rear, and a pair of side edge portions, (iii) a pair of side panels each extending upwardly from and connecting the base to the respective side edge portions of the top panel, (iv) a front end panel extending upwardly from and connecting the base to the front edge portion of the top panel, (v) a rear end panel extending upwardly from and connecting the base to the rear edge portion of the top panel, and (vi) all of said side and end panels maintaining said top panel at an elevated position above the support surface;

(b) at least one amusement-type device mounted on the console within easy reach of a child seated at the same on the support surface; and (c) low-slung seat environment simulator means on the console for permitting a child to operate said one amusement-type device while being seated at the console with legs outstretched so as to create a play environment, including (i) means at the rear of the console for defining a rear cutout which extends forwardly along a central portion of the top panel for a distance sufficient to accomodate the lower torso of the seated child, at least one of said amusement-type devices being mounted on said top panel laterally of said rear cutout and rearwardly of said top panel central portion said rear cutout also extending upwardly along a central portion of the rear panel for a distance sufficient to accomodate the upper thigh region of the seated child, (ii) means at the front of the console for defining a front cutout which extends upwardly along a central portion of the front panel for a distance sufficient to accomodate the legs of the seated child, and (iii) said front and rear cutouts being aligned with one another and together forming a tunnel-like structure which accomodates the outstretched legs of the seated child to thereby simulate a low-slung seat environment.

* * * * *